US005575297A

United States Patent [19]

Hatchett et al.

[11] Patent Number: 5,575,297

[45] Date of Patent: Nov. 19, 1996

[54] HAIR BRAIDING DEVICE

[75] Inventors: Jerry Hatchett, 19 Reynard Dr., Tupelo, Miss. 38801; Debra L. Meredith, Madison, Miss.

[73] Assignee: Jerry Hatchett, Tupelo, Miss.

[21] Appl. No.: 380,032

[22] Filed: Jan. 30, 1995

[51] Int. Cl.[6] ..... A45D 7/02

[52] U.S. Cl. ..... 132/212; 132/213; 132/124; 132/108; 132/143

[58] Field of Search ..... 132/212, 124, 132/213, 223, 214, 108, 109, 111, 162, 110, 143

[56] References Cited

U.S. PATENT DOCUMENTS

| | | | |
|---|---|---|---|
| 1,166,361 | 12/1915 | Grove | 132/110 |
| 1,760,928 | 6/1930 | Whitney | 132/110 |
| 2,482,928 | 9/1949 | Neff et al. | 132/212 |
| 2,895,487 | 7/1959 | Hazzard | 132/143 |
| 2,930,385 | 3/1960 | Fees | 132/214 |
| 4,038,996 | 8/1977 | Eronini et al. | 132/9 |
| 4,307,737 | 12/1981 | Shipman | 132/9 |
| 4,369,690 | 1/1983 | Sapkus | 87/33 |
| 4,427,017 | 1/1984 | Eronini | 132/9 |
| 5,054,504 | 10/1991 | Winrow | 132/110 |
| 5,240,017 | 8/1993 | Terwilliger | 132/124 |

*Primary Examiner*—Gene Mancene
*Assistant Examiner*—Philogene Pedro

[57] ABSTRACT

A generally hand-shaped hair styling device for independently retaining a plurality of separate sections of hair, comprising a rigid frame assembly comprising a curved rigid base with a plurality of adjacent elongated rigid members joined to and arising in a perpendicular manner from the curved rigid base in such a manner that slots are formed between the adjacent elongated members, each of the slots being of sufficient height and width to accommodate and retain a section of hair containing multiple strands of hair, the section consisting of a sufficient number of strands of hair as to be suitable for braiding, wherein the slots contain adjacent resilient surfaces in close proximity to each other, thereby enhancing the ability of the device to retain the sections of the hair.

12 Claims, 5 Drawing Sheets

HAIR BRAIDING DEVICE

BACKGROUND—FIELD OF INVENTION

This invention shows a device for the formation of braids and similar hairstyles.

BACKGROUND—DESCRIPTION OF PRIOR ART

In order to braid hair, the person performing the braiding operation must manipulate three or more sections of hair simultaneously. First, the hair must be combed, brushed, or manually separated into at least three sections. Once this is accomplished, the individual sections of hair must remain neatly separated in order to be woven together into attractive braids and similar hairstyles. With a number of braided hairstyles, more than three sections of hair must be used, and hair from outside the initial sections must be incrementally added to each section as the braid progresses. Manipulation of these multiple sections of hair can be extremely difficult. An unforeseen interruption that causes the person to even momentarily release the sections of hair from their hands is likely to result in a loss of the work that has already been performed. Several prior inventions have attempted to simplify the process of forming braids and similar hairstyles that involve the manipulation of multiple sections of hair:

U.S. Pat. No. 4,307,737 to Shipman shows a hand operated machine with tubular holders for three sections of hair. The three tubular holders are each designed to maintain the separation of the sections of hair, while moving within a system of tracks and guide rails to weave the individual sections of hair into a basic braid.

U.S. Pat. No. 4,369,690 to Sapkus shows another hand operated machine with tubular holders for three sections of hair. In this device, the three tubular holders are rotated in a manner that results in the formation of a basic braid, said rotation being effected by means of a mechanism consisting of a lever and a plurality of gear members.

U.S. Pat. No. 4,038,996 to Eronini and Abia shows a motor driven apparatus designed to use a complex series of gears, shafts, and cams to move a number of parters and grippers that seize sections of hair and eventually weave them into a basic three strand braid.

U.S. Pat. No. 4,427,017 to Eronini shows a modified version of the same device discussed in the previous patent.

The complex mechanical functions of the devices disclosed in these four patents may prove undesirable to the average person who would wish to braid hair. In addition, all are designed to accomplish one style of braid, that style being a basic three strand braid. No provision is made in any of the devices to accommodate more than three sections of hair, meaning that they are not only complex, but quite limited in the hairstyles that users could produce by using the machines.

U.S. Pat. No. 5,240,017 to Terwilliger shows a comb with an attachment on its spine that is designed to hold a single section of hair during a braiding operation, thereby reducing, by one, the number of sections of hair being simultaneously manipulated by hand. While this is advantageous, the number of remaining sections of hair can still be extremely difficult to manipulate with two hands. The description contained in the patent also signifies that the comb is intended for use in professional hairdressing situations, and does not suggest that the comb is particularly suited for use by non-professionals.

From a review of the prior attempts to solve the problems associated with braids and similar hairstyles, it can be summarized that:

(a) the patents to Shipman, Sapkus, and Eronini/Abia disclose complex products that are intended to totally automate the process of braiding hair, as opposed to providing a solution that will enable both professional and non-professional hairdressers to manually perform hair braiding with reasonable ease;

(b) the patents to Shipman, Sapkus, and Eronini/Abia disclose complex products that are extremely specialized in function, and only address the problems associated with the formation of basic three strand braids;

(c) the patent to Terwilliger discloses a product that is simple in design, but also limited in functionality, since it will only accommodate a single section of hair during the braiding process.

OBJECTS AND ADVANTAGES: A SUMMARY OF THE INVENTION

When the difficulties of braiding hair are considered, along with the limitations of the previously developed inventions that attempt to solve the problems, it becomes evident that the performance of hair braiding still poses a significant challenge. This challenge is present both for professional hairdressers and non-professionals who would like to become proficient at the creation of attractive braids and other similar hairstyles that involve the weaving of multiple sections of hair. With this challenge in mind, several objects and advantages of our invention are:

(a) to provide a device that is capable of holding all sections of hair during the formation of braids and other similar hairstyles;

(b) to provide a device that will allow the user to have both hands free should they desire, thus being able to temporarily suspend the braiding operation without risk of destroying the portion of the styling that has already been done;

(c) to provide a device that is easily used by both professional hairdressers and non-professional users who wish to create attractive braided hairstyles;

(d) to provide a device that employs a very simple design and method of use;

(e) to provide a device that is aesthetically attractive;

(f) to provide a device that is inexpensive to manufacture, and therefore inexpensive for the user to purchase;

(g) to provide a device that will enable the user to create virtually any of a very large number of different braids and other similar hairstyles that involve multiple but separate sections of hair;

(h) to provide a device that will enable a non-professional user to create the resulting hairstyles with their own hair, as well as with the hair of others;

Further, our invention provides a device which, by means of being easily manufacturable in different sizes, is configurable for use on the hair of virtually any size or age of person, provided their hair is of sufficient length as to permit manual braiding. Offering further flexibility, our invention provides a device that is compatible with many different textures of hair, causes discomfort to the person whose hair is being braided with the aid of the device, and is constructed in a manner that is not damaging to the hair that is being styled into braids or other similar hairstyles. The design of the device also incorporates features that serve the purposes of both functionality and safety of use.

Briefly summarized, the presently described embodiment of the invention comprise a generally hand-shaped hair styling device comprising a rigid internal skeletal frame assembly consisting of a curved rigid base with a plurality of elongated rigid members joined to and arising from said curved base, with all portions of said skeletal structure, other than the underside of said rigid base, covered with a resilient material, substantially forming a plurality of adjacent elongated members that are capable of independently retaining a plurality of separate sections of hair that are being manipulated during a hair styling process. Still further objects and advantages of the device disclosed within this patent will become apparent from a consideration of the ensuing description and drawings.

DRAWING FIGURES

In the drawings, similar pans have the same number but different alphabetic suffixes.

FIGS. 4*a* to 4*h* show front elevational views of the fully assembled device, and are included to clarify the description of the method of operation of the device.

Figure 5A:
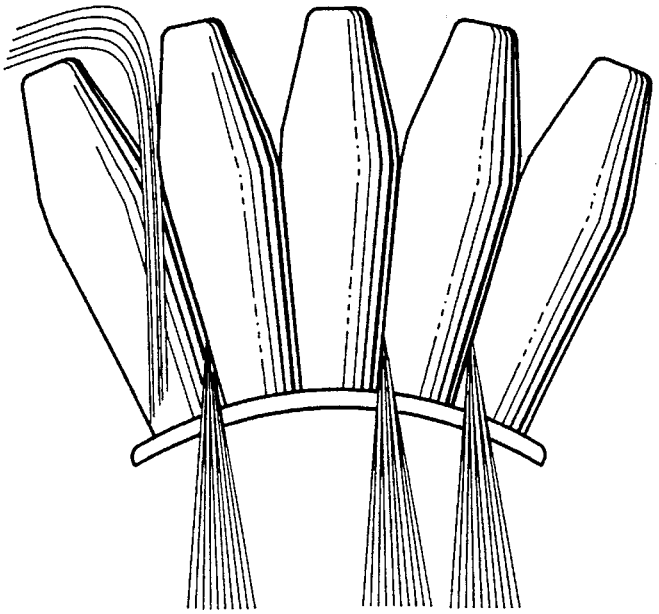
Figure 5B:
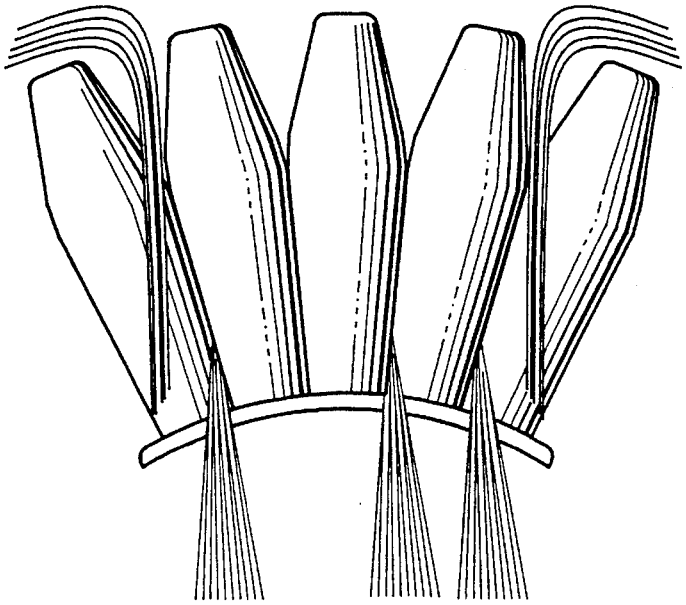

FIGS. 5*a* and 5*b* show front elevational views of the fully assembled device, and are included to further clarify the description of the method of operation of the device.

REFERENCE NUMERALS IN DRAWINGS

10 Rigid base
11 Skeletal support members (5)
12 Skeletal frame assembly
13 Resilient base
14 Resilient elongated members (5)
15 Resilient outer covering
16 Elongated hair retention arms (5)
17 Hair retention slots (4)

Figure 1:
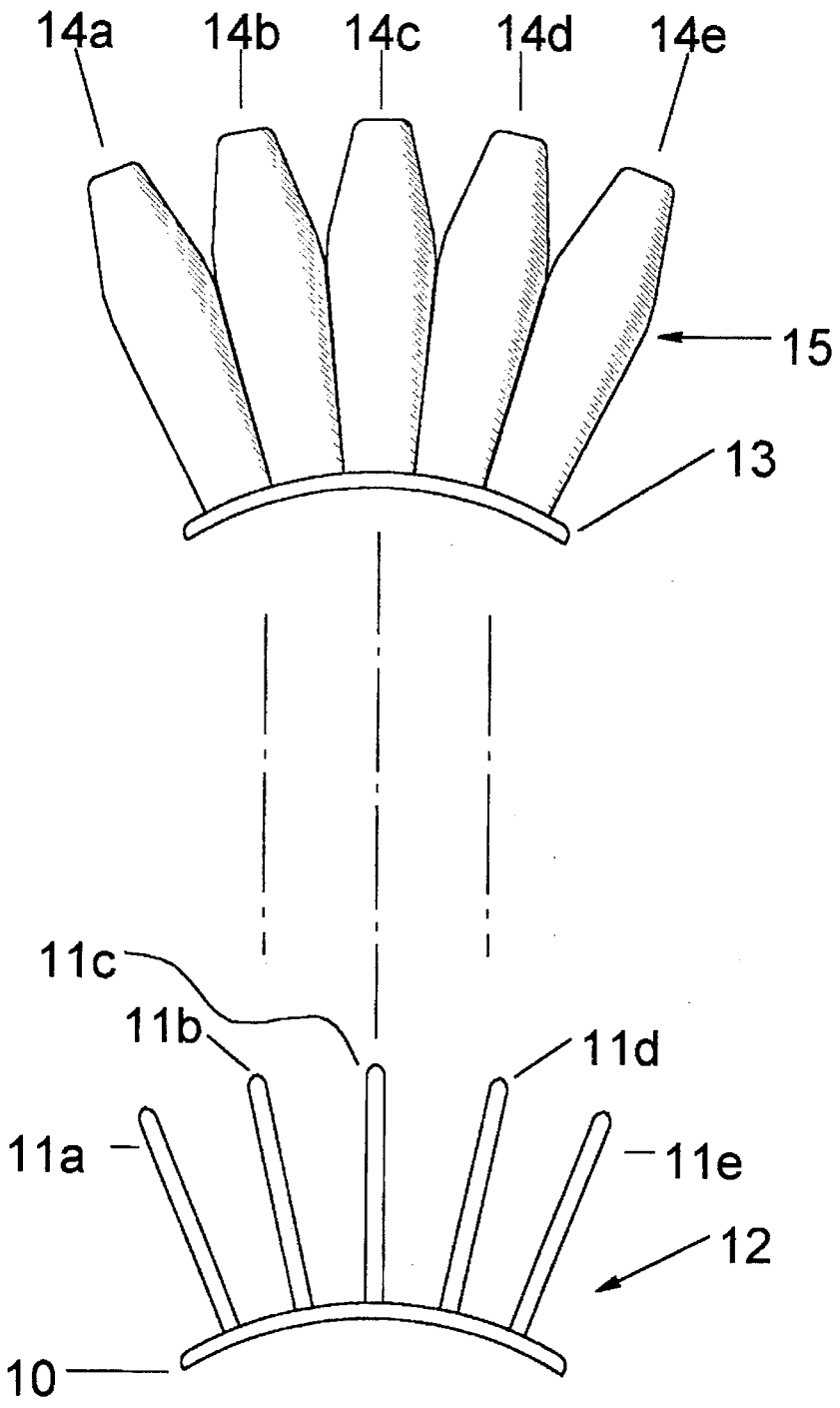
FIG. 1 shows an exploded view of the two main components that are assembled to form the device. Also shown in Figure I are the individual components that are integrated during the manufacturing process to form these two main components.
Figure 2:
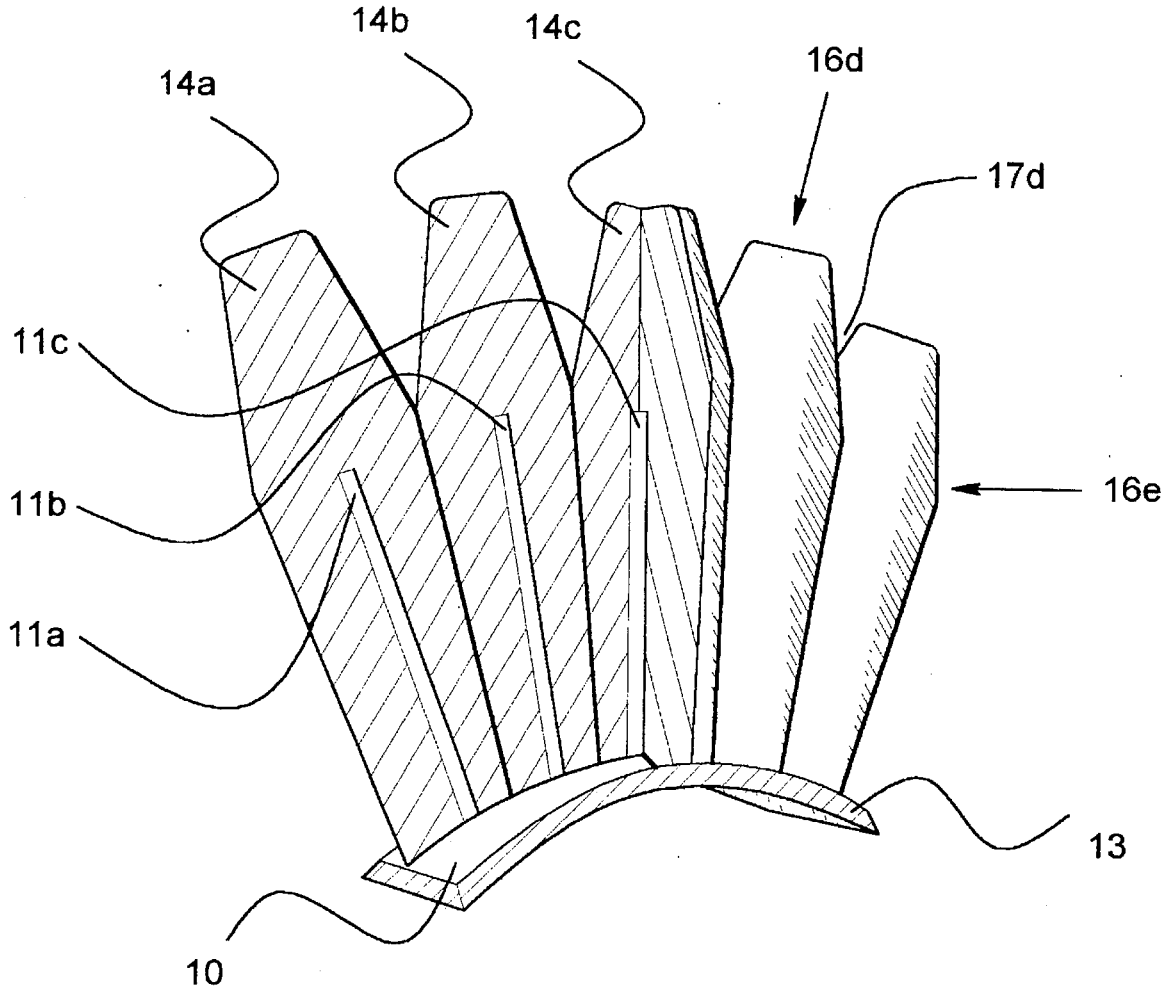
FIG. 2 shows a perspective cross-sectional view of the device in its final·assembled form.
Figure 3:
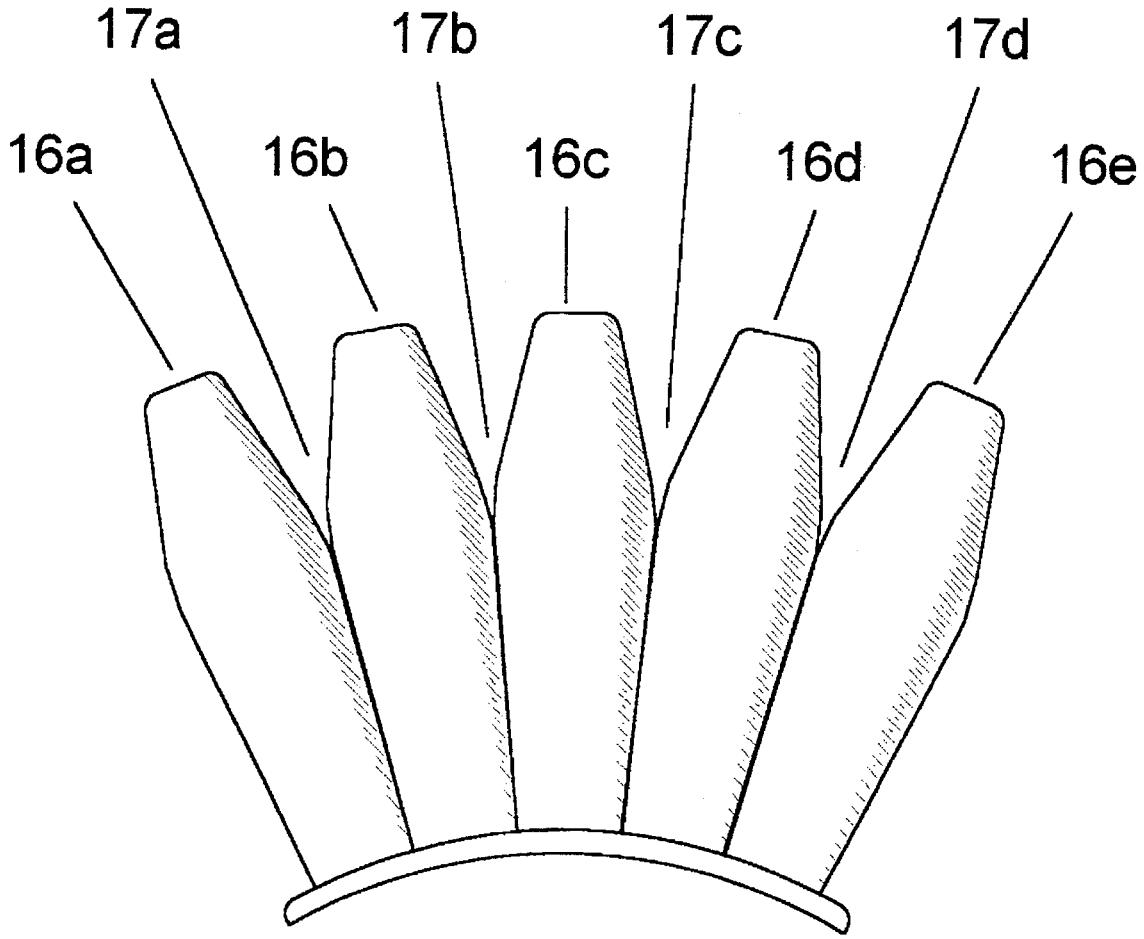
FIG. 3 shows a front elevational view of the fully assembled device.

DESCRIPTION—FIGS. 1 to 3

A typical embodiment of the present invention is illustrated in FIG. 1 (exploded perspective view), FIG. 2 (perspective cross-sectional view), and FIG. 3 (front elevational view.)

FIGS. 1 and 2 provide a detailed illustration of the typical construction of the hair braiding device. A rigid base 10 of uniform cross section, with the thickness typically being approximately ⅛". The width and depth of the rigid base 10 will vary according to the size of hair braiding device being manufactured, but a typical width would be approximately three to five inches, with the typical depth being ¾" to 10 ¼. The rigid base 10 provides the overall base for the hair braiding device, and is curved in a shape that approximates the curvature of the back of a human head. Five (5) skeletal support members 11 extend in an upward vertical fashion from the rigid base 10. All of the skeletal support members 11 are of equal diameter, typically ¼", and all of the skeletal support members 11 are of equal height, typically 1½" to 2". Each of the skeletal support members 11 rises perpendicularly from the rigid base 10. As a result of the curvature of the rigid base 10, the skeletal support members 11 are positioned in a horizontally angular manner in relation to each other, which increases the horizontal space between the skeletal support members 11 as they rise upward. When the skeletal support members 11 are combined with the rigid base 10, said combination typically taking place in the manufacturing process, the result is a skeletal frame assembly 12 that provides the rigidity for the hair braiding device.

Also evident in FIG. 1 is an additional base constructed of a soft foam material, or any other material which exhibits similar characteristics of elasticity, weight, density, resiliency, and texture. The resilient base 13 is of uniform cross section, with the thickness typically being approximately ⅛" to ½". The width and depth of the resilient base 13 will vary according to the size of hair braiding device being manufactured, but a typical width would be approximately three to five inches, with the typical depth being ¾" to 1¼", said width and depth being the same as that of the rigid base 10. Five (5) resilient elongated members 14 extend in an upward vertical fashion from the resilient base 13, and are constructed of the same foam or similar material that comprises the resilient base 13. The diameter of each of the resilient elongated members 14 is the same as the depth of the resilient base 13, which is in turn the same depth as the rigid base 10. Each of the resilient elongated members 14 contains an internal cylindrical cavity that extends along its vertical axis, said cavity commencing at the bottom of the sheath, and extending upward within the sheath, to a height equivalent to the height of one of the skeletal support members 11. The diameter of the cavity within each of the foam sheaths is equivalent to the diameter of one of the skeletal support members 11. Each of the resilient elongated members 14 is tapered on its vertical axis, said tapering occurring during approximately the topmost twenty percent (20%) of its vertical height. This tapering reduces the diameter of each of the resilient elongated members 14 by approximately fifty percent (50%), with the smallest portion of the taper being at the topmost end of each of the resilient elongated members 14. Each of the resilient elongated members 14 rises perpendicularly from the resilient base 13. When the resilient elongated members 14 are combined with the resilient base 13, said combination typically being achieved either by manufacturing the resilient base 13 and the resilient elongated members 14 as a single unit, or by attaching the resilient elongated members 14 to the resilient base 13 by means of suitable adhesive, the result is a resilient outer covering 15 that provides the outer surfaces for the hair braiding device. Another distinct advantage of joining the bases of the resilient elongated members 14 to the resilient base 13 is that this union prevents hair from being entrapped or entangled under the bases of the resilient elongated members 14.

As depicted in FIG. 1, final assembly of the hair braiding device is accomplished by insertion of the skeletal frame assembly 12 into the resilient outer covering 15. This insertion is made possible by the presence of the cavities within the resilient elongated members 14, which correspond in height and diameter with the skeletal support members 11 of the skeletal frame assembly 12. When the skeletal frame assembly 12 is fully inserted within the resilient outer coveting 15, the bottom of the resilient base 13 is attached to the top of the rigid base 10 by use of an appropriate adhesive substance. As can be seen in FIG. 2, the skeletal support members 11 do not extend into the tapered portions of the resilient elongated members 14, offering even more flexibility and convenience for the insertion of the hair into the hair retention slots 17.

A cross sectional perspective view of the hair braiding device is illustrated in FIG. 2, and a front elevational view can be seen in FIG. 3. With the insertion of the skeletal frame assembly 12 into the resilient outer covering 15, the hair braiding device is complete, and takes the form of an internally rigid structure with a soft, pliable outer covering. The combination of the skeletal support members 11 within the resilient elongated members 14 results in the formation of five (5) elongated hair retention arms 16. The adjacency of the elongated hair retention arms 16 one to another forms four (4) hair retention slots 17, which can also be seen in FIGS. 2 and 3. The tapered tops of the elongated hair retention arms 16 provide for wide openings at the tops of the hair retention slots 17. Proceeding downward from the tops of the hair retention slots 17, the wide openings become more narrow, and end at the base of the tapered sections of the elongated hair retention arms 16. The hair retention slots 17 continue to the bottoms of the elongated hair retention arms 16, with the pressure exerted by the adjacency of the elongated hair retention arms 16 one to another providing a gripping force that is capable of firmly retaining sections of hair that are being manipulated. From the description above, a number of advantages of our hair braiding device become evident:

(a) Plastic, foam or a similar material, and a small amount of adhesive are the only materials required to manufacture our hair braiding device, eliminating the need for complicated procurement procedures involving many different sources.

(b) Only two (2) of the needed materials will be visible in the assembled final product. Both of these materials are easily manufactured or obtainable in virtually any color, offering a great degree of aesthetic flexibility in the manufacturing process.

(c) All three (3) of the materials present in our hair braiding device are inexpensively produced.

(d) All three (3) of the materials present in our hair braiding device can be totally non-toxic in nature.

(e) With only two (2) major components, assembly of our hair braiding device will require very little labor, adding to the economic advantages of its production.

(f) The resilient outer coveting 15 comprises virtually all of the surfaces of our hair braiding device that the user will come into contact with. The soft, pliable nature of the resilient outer covering 15, along with a total absence of any exposed sharp edges will make our hair braiding device an extremely safe product to use.

OPERATION—FIGS. 4*a* to 4*h*

Figure 4A:
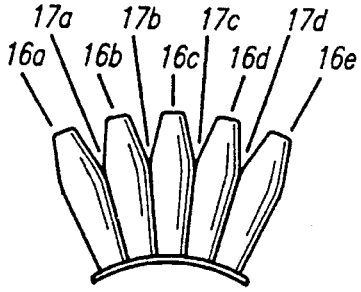
Figure 4B:
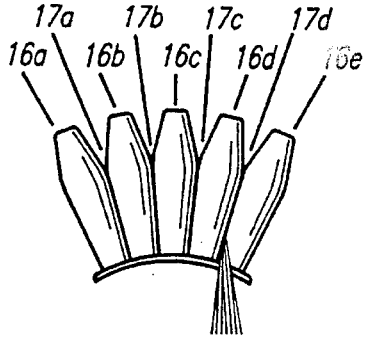

In use, the hairdresser must comb, brush, or manually separate the hair into at least three sections for braiding. In a typical use, as the hairdresser would extract the first section of hair, then place the hair braiding device's curved base against the head, slightly under the area where the sections of hair join the head, and insert the section of hair into one of the hair retention slots 17. (FIG. 4*b*)

Figure 4C:
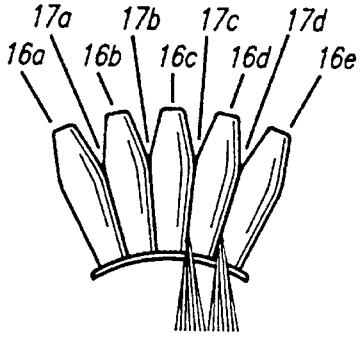
Figure 4D:
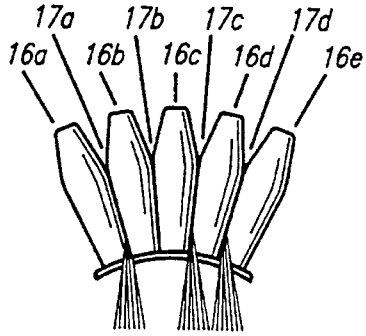
Figure 4E:
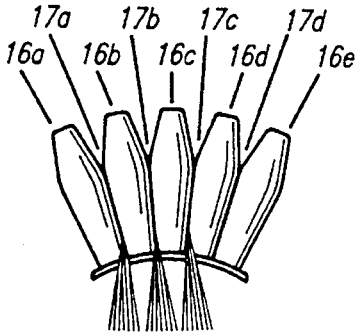

The pressure of the elongated hair retention arms 16 pressing against each other is sufficient to hold a section of hair in place, yet the flexibility and softness of the foam or similar material is such that the hair is not damaged at all. The hairdresser can then totally release both the section of hair and the hair braiding device. The section of hair is firmly retained within the hair retention slot, and the lightweight construction of the hair braiding device is such that it will hang freely for long periods of time without the section of hair slipping out of the hair retention slot that is holding it. The hairdresser is then free to gather another section of hair, and place it in another of the hair retention slots 17. (FIG. 4*c*)

Since a typical embodiment of the hair braiding device features four (4) hair retention slots 17 (FIG. 4*a*), the hairdresser can use the hair braiding device to simultaneously retain all of the individual sections of hair needed for virtually any braided hairstyle. In fact, during the vast majority of braiding operations, only three (3) of the hair retention slots 17 will be occupied at any given time, leaving one hair retention slot that remains vacant. (FIG. 4*d*) This is of significant importance to the design of the hair braiding device. With one vacant hair retention slot present during virtually all braiding operations, the hairdresser has the advantage of not having to handle more than one section of hair at any given time, thereby totally solving the difficult problem of attempting to manipulate many sections of hair simultaneously. With the vacant hair retention slot present (FIG. 4*d*), the hairdresser is able to simply move the rightmost section of hair from hair retention slots 17*d* to hair retention slots 17*b*, resulting in the configuration shown in FIG. 4*e*, and completing the first step of the actual braid.

Figure 4F:
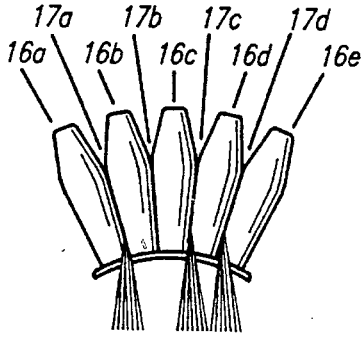
Figure 4G:
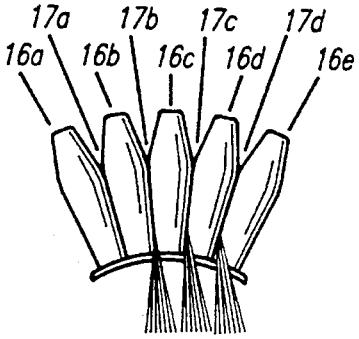

Moving what is now the rightmost section of hair from hair retention slots 17*c* to hair retention slots 17*d* results in the configuration shown in FIG. 4*f*.

Moving the leftmost section of hair from hair retention slots 17*a* to hair retention slots 17*c* results in the configuration shown in 4*g*, and finishes the first knot of the braid.

Figure 4H:
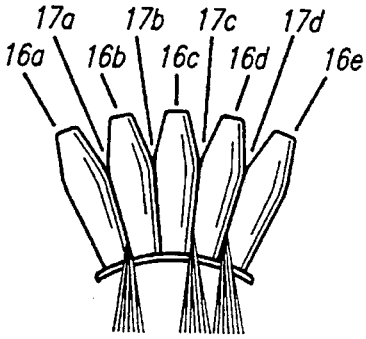

Moving what is now the leftmost section of hair from hair retention slots 17*b* to hair retention slots 17*a* results in the configuration shown in FIG. 4*h*. This configuration is identical to the configuration shown in 4*d*, other than the fact that a completed braid knot is now present directly on the other side of the hair braiding device. (FIG. 5*a*) The steps represented in FIGS. 4*d* to 4*h* are performed repeatedly until the entire strands of hair have been braided, and at no time in these steps must the hairdresser handle more than one section of hair. In addition, the formation of the braid knot on the input side of the hair braiding device exerts pressure on the hair braiding device, causing it to slide downward on the sections of hair being retained, which further prepares the hair braiding device for the next braid knot to be formed.

Further objects and advantages can be seen in our hair braiding device when performing more complex braids and similar hairstyles. A typical example of a more complex braid is known as the French braid. In this hairstyle, the first braid knot is performed in exactly the same manner as described in the discussion above, and illustrated in FIGS. 4*a* to 4*h*. Once the first braid knot has been performed, however, the process become much more difficult to accomplish manually. This hairstyle requires additional smaller sections of hair to be added to the existing sections as the braiding operation progresses. When performing this operation manually, the hairdresser must simultaneously manipulate as many as five (5) sections of hair. With our hair braiding device, the additional sections of hair are simply placed into the appropriate hair retention slots 17 (FIGS. 5*a* and 5*b*), which already contain the existing sections of hair to which the new sections are added. Therefore, instead of having to simultaneously manipulate as many as five (5) sections of hair, the hairdresser once again is able to form the complex braid knots without ever being forced to handle more than one (1) section of hair at any given time.

Although we have discussed many specific details in the preceding paragraphs, it is important to understand that the usage examples given should not be construed as limiting the scope of the invention, but as merely providing typical examples of usage of the presently preferred embodiment of this invention, which was discussed in detail, and shown in the accompanying drawings. The invention could easily be manufactured with a different number of hair retention arms, facilitating more effective and more efficient formation of any hairstyle that involves the need to maintain separate sections of hair without tangling or intermingling during the styling process.

The invention could also be constructed in a manner that leaves more of the frame assembly exposed, so long as the resilient material is still present within the hair retention slots.

Thus the scope of the invention should be determined by the appended claims and their legal equivalents, rather than by the examples given.

We claim:

1. A hair styling device providing means for independently retaining a plurality of separate sections of hair, comprising a rigid frame assembly comprising a rigid base with a plurality of elongated rigid members adjacently joined to and arising from said rigid base in such a manner that slots are formed between the adjacent elongated members, each of said slots being of sufficient height and width to accommodate and retain a section of hair containing multiple strands of hair, said section consisting of a sufficient number of strands of hair as to be suitable for braiding, wherein said slots contain adjacent resilient surfaces in close proximity to each other, thereby enhancing the ability of said device to retain said sections of hair.

2. The device of claim 1 wherein said resilient surfaces are constructed from foam rubber.

3. The device of claim 1 wherein said resilient surfaces are constructed from materials other than foam rubber, while said materials exhibit similar physical properties to that of foam rubber, enabling said materials to perform the same functions within said device as would foam rubber.

4. The device of claim 1 wherein said resilient surfaces are tapered at their tops in such a manner that access to said slots is more convenient for the purposes of inserting a section of hair containing multiple strands of hair, said section consisting of a sufficient number of strands of hair as to be suitable for braiding.

5. A generally hand-shaped hair styling device providing means for independently retaining a plurality of separate sections of hair, comprising a rigid frame assembly comprising a curved rigid base with a plurality of adjacent elongated rigid members joined to and arising in a perpendicular manner from said curved rigid base in such a manner that slots are formed between the adjacent elongated members, each of said slots being of sufficient height and width to accommodate and retain a section of hair containing multiple strands of hair, said section consisting of a sufficient number of strands of hair as to be suitable for braiding, wherein said slots contain adjacent resilient surfaces in close proximity to each other, thereby enhancing the ability of said device to retain said sections of hair.

6. The device of claim 5 wherein said resilient surfaces are constructed from foam rubber.

7. The device of claim 5 wherein said resilient surfaces are constructed from materials other than foam rubber, while said materials exhibit similar physical properties to that of foam rubber, enabling said materials to perform the same functions within said device as would foam rubber.

8. The device of claim 5 wherein said resilient surfaces are tapered at their tops in such a manner that access to said slots is more convenient for the purposes of inserting a section of hair containing multiple strands of hair, said section consisting of a sufficient number of strands of hair as to be suitable for braiding.

9. A hair styling device providing means for independently retaining a plurality of separate sections of hair, comprising a semi-rigid frame assembly comprising a semi-rigid base with a plurality of elongated semi-rigid members adjacently joined to and arising from said semi-rigid base in such a manner that slots are formed between the adjacent elongated members, each of said slots being of sufficient height and width to accommodate and retain a section of hair containing multiple strands of hair, said section consisting of a sufficient number of strands of hair as to be suitable for braiding, wherein said slots contain adjacent resilient surfaces in close proximity to each other, thereby enhancing the ability of said device to retain said sections of hair.

10. The device of claim 9 wherein said resilient surfaces are constructed from foam rubber.

11. The device of claim 9 wherein said resilient surfaces are constructed from materials other than foam rubber, while said materials exhibit similar physical properties to that of foam rubber, enabling said materials to perform the same functions within said device as would foam rubber.

12. The device of claim 9 wherein said resilient surfaces are tapered at their tops in such a manner that access to said slots is more convenient for the purposes of inserting a section of hair containing multiple strands of hair, said section consisting of a sufficient number of strands of hair as to be suitable for braiding.

* * * * *